US007014880B2

(12) United States Patent
Wood et al.

(10) Patent No.: US 7,014,880 B2
(45) Date of Patent: Mar. 21, 2006

(54) PROCESS OF VACUUM EVAPORATION OF AN ELECTRICALLY CONDUCTIVE MATERIAL FOR NANOELECTROSPRAY EMITTER COATINGS

(75) Inventors: Troy D. Wood, Kenmore, NY (US); Douglas R. Smith, Buffalo, NY (US)

(73) Assignee: The Research Foundation of State University of New York, Amherst, NY (US)

( * ) Notice: Subject to any disclaimer, the term of this patent is extended or adjusted under 35 U.S.C. 154(b) by 0 days.

(21) Appl. No.: 10/847,197

(22) Filed: May 17, 2004

(65) Prior Publication Data

US 2004/0245463 A1 Dec. 9, 2004

Related U.S. Application Data

(60) Provisional application No. 60/471,612, filed on May 19, 2003.

(51) Int. Cl.
*B05D 5/12* (2006.01)

(52) U.S. Cl. ..... 427/69; 239/706; 148/240

(58) Field of Classification Search ..... 250/288; 427/69; 239/706, 690; 148/240
See application file for complete search history.

(56) References Cited

U.S. PATENT DOCUMENTS 4,885,076 A * 12/1989 Smith et al. ..... 204/451
5,296,274 A 3/1994 Movchan et al.
5,788,166 A 8/1998 Valaskovic et al.
6,310,431 B1 10/2001 Blanchet-Fincher et al.
6,331,332 B1 12/2001 Wang
6,633,031 B1 * 10/2003 Schultz et al. ..... 250/288
6,670,607 B1 * 12/2003 Wood et al. ..... 250/288

OTHER PUBLICATIONS

Valaskovic et al., "Attomole-Sensitivity Electrospray Source for Large-Molecule Mass Spectrometry," *Anal. Chem.*, 67:3802-3805 (1995).
Emmett et al., "Micro-Electrospray Mass Spectrometry: Ultra-High-Sensitivity Analysis of Peptides and Proteins," *J. Am. Soc. Mass Spectrom.*, 5:605-613 (1994).
Wilm et al., "Analytical Properties of the Nanoelectrospray Ion Source," *Anal. Chem.*, 68:1-8 (1996).
Kriger et al., "Durable Gold-Coated Fused Silica Capillaries for Use in Electrospray Mass Spectrometry," *Anal. Chem.*, 67:385-389 (1995).
Valaskovic et al., "Long-Lived Metallized Tips for Nanoliter Electrospray Mass Spectrometry," *J. Am. Soc. Mass Spectrom.*, 7:1270-1272 (1996).
Kelly et al., "Capillary Zone Electrophoresis-Electrospray Mass Spectrometry at Submicroliter Flow Rates: Practical Considerations and Analytical Performance," *Anal. Chem.*, 69:51-60 (1997).
Barnidge et al., "A Design for Low-Flow Sheathless Electrospray Emitters," *Anal. Chem.*, 71:4115-4118 (1999).
Wetterhall et al., "A Novel Design for Sheathless Electrospray and Nanospray Implementing Low Flow Applications Interfaced with Mass Spectrometry," Proceedings of the 49th ASMS Conference on Mass Spectrometry and Allied Topics, Chicago, Illinois.
Wetterhall et al., "A Conductive Polymeric Material Used for Nanospray Needle and Low-Flow Sheathless Electrospray Ionization Applications," *Anal. Chem.*, 74:239-245 (2002).

(Continued)

*Primary Examiner*—Kiet T. Nguyen
(74) *Attorney, Agent, or Firm*—Nixon Peabody LLP

(57) ABSTRACT

The present invention discloses a method for coating nanoelectrospray emitters. The method involves providing a nanoelectrospray emitter body and evaporating an electrically conductive material under conditions effective to form a thin layer of the electrically conductive material onto the nanoelectrospray emitter body.

10 Claims, 5 Drawing Sheets

OTHER PUBLICATIONS

White et al., "An Alternative Emitter for Low-Flow Electrospray Ionization," *Am. Biotechnol. Lab,* 20:16-18 (2002).
Maziarz III et al.. "Polyaniline: A Conductive Polymer Coating for Durable Nanospray Emitters," *J. Am. Soc. Mass Spectrom.,* 11:659-663 (2000).
Nilsson et al., "A Simple and Robust Conductive Graphite Coating for Sheathless Electrospray Emitters Used in Capillary Electrophoresis/Mass Spectrometry," *Rapid Commun. Mass Spectrom.,* 15:1997-2000 (2001).
Zhu et al., "A Colloidal Graphite-Coated Emitter for Sheathless Capillary Electrophoresis/Nanoelectrospray Ionization Mass Spectrometry," *Anal. Chem.,* 74:5405-5409 (2002).
Chang et al., "Sheathless Capillary Electrophoresis/Electrospray Mass Spectrometry Using a Carbon-Coated Fused-Silica Capillary," *Anal. Chem.,* 72:626-630 (2000).
Chang et al., "Sheathless Capillary Electrophoresis/Electrospray Mass Spectrometry Using a Carbon-Coated Tapered Fused-Silica Capillary with a Beveled Edge," *Anal. Chem.,* 73:5083-5087 (2001).
Barroso et al., "Sheathless Preconcentration-Capillary Zone Electrophoresis-Mass Spectrometry Applied to Peptide Analysis," *J. Am. Soc. Mass Spectrom,* 10:1271-1278, (1999).
Smith et al., "Graphite-Coated Nanoelectrospray Emitter for Mass Spectrometry," *Anal. Chem.,* 75:7015-7019 (2003).
Wood et al., "Nanoelectrospray Using Polyaniline-Coated Emitters," 225th ACS National Meeting, New Orleans, LA (2003).

* cited by examiner

PROCESS OF VACUUM EVAPORATION OF AN ELECTRICALLY CONDUCTIVE MATERIAL FOR NANOELECTROSPRAY EMITTER COATINGS

This application claims the benefit of U.S. Provisional Patent Application Ser. No. 60/471,612, filed May 19, 2003, which is hereby incorporated by reference in its entirety.

This invention arose out of research sponsored by the NSF and NIH (Grant Nos. CHE-0094961, IR43-RR016399-01, and S10RR14572). The U.S. Government may have certain rights in this invention.

FIELD OF THE INVENTION

The present invention relates to methods for coating nanoelectrospray emitters by providing a nanoelectrospray emitter body and evaporating an electrically conductive material to form a thin layer of the electrically conductive material onto the nanoelectrospray emitter body.

BACKGROUND OF THE INVENTION

As nanoelectrospray ionization continues to grow and gain acceptance as a valuable research tool within the mass spectrometry field, there has been a push to produce nanoelectrospray emitters which are inexpensive and have long lifetimes. "Nanoelectrospray" was first developed by Wilm and Mann in 1994 (Wilm and Mann, "Electrospray and Taylor-Cone Theory, Dole's Beam of Macromolecules at Last?" *Int. J. Mass Spectrom. Ion Processes,* 136(1):167–180 (1994); Wilm and Mann, "Analytical Properties of the Nanoelectrospray Ion Source," *Anal. Chem.,* 68(1):1–8 (1996) ). Their technique used a pulled-glass substrate as the electrospray ionization emitter. Nanoelectrospray is a static technique and relies upon capillary action induced by the applied electric field to draw the solution to the emitter tip so that it can be electrosprayed (Wood et al., "Miniaturization of Electrospray Ionization Mass Spectrometry," *Applied Spectroscopy Reviews,* 38(2):187–244 (2003) ); therefore, no forced flow (from a syringe pump or LC pump) is needed, and flow rates are generally in the tens of nanoliters per minute. The droplets produced have 100–1000 times less volume than those produced with conventional electrospray, and desolvation does not require the use of a nebulizing gas to aid the drying of the droplets. These advantages lead to increased sensitivity and decreased limits of detection, making nanoelectrospray the technique of choice when sample volumes and analyte concentrations are limited.

Initial nanoelectrospray emitters used pulled-glass substrates with a metal, typically gold, as the applied conductive medium (Wilm and Mann, "Electrospray and Taylor-Cone Theory, Dole's Beam of Macromolecules at Last?" *Int. J. Mass Spectrom. Ion Processes,* 136(1):167–180 (1994); Wilm and Mann, "Analytical Properties of the Nanoelectrospray Ion Source," *Anal. Chem.,* 68(1):1–8 (1996); Valaskovic et al., "Attomole-Sensitivity Electrospray Source for Large-Molecule Mass Spectrometry," *Anal. Chem.,* 67(20): 3802–3805 (1995) ). However, these emitters suffered from the susceptibility of the conductive metal to be ablated from the glass surface through a coronal discharge (Wood et al., "Miniaturization of Electrospray Ionization Mass Spectrometry," *Applied Spectroscopy Reviews,* 38(2): 187–244 (2003) ). Much work has been done to stabilize and protect these metal coatings in an effort to increase the emitter lifetime (Kriger et al., "Durable Gold-Coated Fused Silica Capillaries for Use in Electrospray Mass Spectrometry," *Anal. Chem.,* 67(2):385–389 (1995); Nilsson et al., "On-Column Conductive Coating for Thermolabile Columns Used in Capillary Zone Electrophoresis Sheathless Electrospray Ionisation Mass Spectrometry," *Rapid Commun. Mass Spectrom.,* 14(1):6–11 (2000); Valaskovic et al., "Long-Lived Metallized Tips for Nanoliter Electrospray Mass Spectrometry," *J. Am. Soc. Mass Spectrom.,* 7(12):1270–1272 (1996); Barnidge et al., "A Design for Low-Flow Sheathless Electrospray Emitters," *Anal. Chem.,* 71:4115–4118 (1999)). However, these techniques greatly add to the production time and cost of the emitter.

Another approach has been to use polymer-based systems, either a conductive polymer (Bigwarfe et al., "Polyaniline-Coated Nanoelectrospray Emitters: Performance Characteristics in the Negative Ion Mode," *Rapid Commun. Mass Spectrom.,* 16:2266–2272 (2002); Maziarz et al., "Polyaniline: A Conductive Polymer Coating for Durable Nanospray Emitters," *J. Am. Soc. Mass. Spectrom.,* 11(7): 659–663 (2000); White and Wood, "A Unique Alternative Emitter for Low-Flow Electrospray Ionization," *Am. Biotechnol. Lab.,* 20:16, 18 (2002); White and Wood, "Reproducibility in Fabrication and Analytical Performance of Polyaniline-Coated Nanoelectrospray Emitters," *Anal. Chem.,* 75:3660–3665 (2003)) or a nonconductive polymer doped with conductive material (Nilsson et al., "A Simple and Robust Conductive Graphite Coating for Sheathless Electrospray Emitters Used in Capillary Electrophoresis/Mass Spectrometry," *Rapid Communications in Mass Spectrometry,* 15(21):1997–2000 (2001); Wetterhall et al., "A Conductive Polymeric Material Used for Nanospray Needle and Low-Flow Sheathless Electrospray Ionization Applications," *Anal. Chem.,* 74:239–245 (2002)). These emitters have shown better resilience to electrical discharge and the longer lifetimes needed for the coupling of online separation techniques. These systems are generally cheaper than their metal counterparts, and some require less handling during manufacture.

Another approach has been to insert a metal wire into the untapered end of the emitter in order to make electrical contact with the solution (Fong and Chan, "A Novel Nonmetallized Tip for Electrospray Mass Spectrometry at Nanoliter Flow Rate," *J. Am. Soc. Mass Spectrom.,* 10(1):72–75 (1999); Van Berkel et al., "Electrochemical Processes in a Wire-in-a-Capillary Bulk-Loaded, Nano-Electrospray Emitter," *J. Am. Soc. Mass Spectrom.,* 12:853–862 (2001); Cao and Moini, "A Novel Sheathless Interface for Capillary Electrophoresis/Electrospray Ionization Mass Spectrometry Using an In-Capillary Electrode," *J. Am. Soc. Mass Spectrom.,* 8:561–564 (1997); Kelleher et al., "Unit Resolution Mass Spectra of 112 kDa Molecules with 3 Da Accuracy," *J. Am. Soc. Mass Spectrom.,* 8(4):380–383 (1997)). This eliminates the need for an external coating. This technique can become labor-intensive, and it might not be suitable for online separations like capillary LC. It has also been shown that the metal wire used as an electrode may undergo electrolysis and produce additional species whose ions further complicate the observed mass spectrum (Van Berkel et al., "Electrochemical Processes in a Wire-in-a-Capillary Bulk-Loaded, Nano-Electrospray Emitter," *J. Am. Soc. Mass Spectrom.,* 12:853–862 (2001)).

A third alternative has been to use carbon or graphite as the conductive medium. Many different types of carbon have been used, such as colloidal graphite (Zhu et al., "A Colloidal Graphite-Coated Emitter for Sheathless Capillary Electrophoresis/Nanoelectrospray Ionization Mass Spectrometry." *Anal. Chem.,* 74(20):5405–5409 (2002)), carbon particles glued to glass (Nilsson et al., "A Simple and Robust Conductive Graphite Coating for Sheathless Electrospray Emitters Used in Capillary Electrophoresis/Mass Spectrometry," *Rapid Communications in Mass Spectrometry,* 15(21): 1997–2000 (2001); Wetterhall et al., "A Conductive Polymeric Material Used for Nanospray Needle and Low-Flow Sheathless Electrospray Ionization Applications," *Anal. Chem.,* 74:239–245 (2002)), and even a soft pencil (Chang and Her, "Sheathless Capillary Electrophoresis/Electrospray Mass Spectrometry Using a Carbon-Coated Fused-Silica Capillary," *Anal. Chem.,* 72(3):626–630 (2000); Chang et al., "Sheathless Capillary Electrophoresis/Electrospray Mass Spectrometry Using a Carbon-Coated Tapered Fused-Silica Capillary with a Beveled Edge," *Anal. Chem.,* 73(21): 5083–5087 (2001)). Early carbon emitters have shown the feasibility of using carbon as a conductive medium, but their manufacture suffers from many of the same drawbacks as other coating techniques.

The present invention is directed to overcoming these deficiencies in the art.

SUMMARY OF THE INVENTION

The present invention relates to a method for coating nanoelectrospray emitters. The method involves providing a nanoelectrospray emitter body and evaporating an electrically conductive material under conditions effective to form a thin layer of the electrically conductive material onto the nanoelectrospray emitter body.

The present invention discloses a new, more rapid method for coating nanoelectrospray emitters with an electrically conductive material using a vacuum evaporation chamber. Evaporated coating offers many advantages over other forms of emitter coatings. The most apparent is the ease of coating. For example, using a graphite rod electrode and introducing an arc, graphite can be evaporated onto the surface of the glass. Such simplicity leads to reduced probability of fracturing the fine tapers of the emitters through operator handling. This is particularly true when one considers the procedure developed by Chang and coworkers with the graphite pencil (Chang and Her, "Sheathless Capillary Electrophoresis/Electrospray Mass Spectrometry Using a Carbon-Coated Fused-Silica Capillary," *Anal. Chem.,* 72(3): 626–630 (2000); Chang et al., "Sheathless Capillary Electrophoresis/Electrospray Mass Spectrometry Using a Carbon-Coated Tapered Fused-Silica Capillary with a Beveled Edge," *Anal. Chem.,* 73(21):5083–5087 (2001), which are hereby incorporated by reference in their entirety). The pencil might work on thick-walled silica, but any pressure on a pulled taper would cause the emitter to fracture and become unusable. A third advantage is the possibility of mass production of nanoelectrospray emitters in a short period of time. Many emitters can be placed within the vacuum chamber and, provided they are not touching one another, can be coated simultaneously. To date, over 30 emitters have been coated at once taking about 20 minutes for the entire procedure. This equates to one emitter taking only 40 seconds to complete. However, in principle, more than 30 emitters can be coated simultaneously. This yields a tremendous advantage over the "dipping" techniques (White and Wood, "Reproducibility in Fabrication and Analytical Performance of Polyaniline-Coated Nanoelectrospray Emitters," *Anal. Chem.,* 75:3660–3665 (2003); Zhu et al., "A Colloidal Graphite-Coated Emitter for Sheathless Capillary Electrophoresis/Nanoelectrospray Ionization Mass Spectrometry." *Anal. Chem.,* 74(20):5405–5409 (2002), which are hereby incorporated by reference in their entirety) in which the emitters are dipped into a suspension of graphite or polyaniline. This dipping approach lengthens fabrication time to a few minutes per emitter. In addition, the method of the present invention is also environmentally friendly, because no solvents are needed to apply the conductive coating, unlike most other coating techniques (particularly those that require dipping) which use volatile solvents that evaporate into the air. Finally, the conductive coating applied to the borosilicate emitters (having tapers of around 4 $\mu$m i.d.) is only 20–30 nm thick, allowing for optical transparency with the emitters. The conductive coating is stable for a number of hours at the high voltages used for nanoelectrospray ionization, and is durable in both positive and negative ion mode—even during electrical discharge. This stability makes it possible to couple these emitters with online separations like capillary liquid chromatography or capillary electrophoresis.

DETAILED DESCRIPTION OF THE INVENTION

Figure 1:
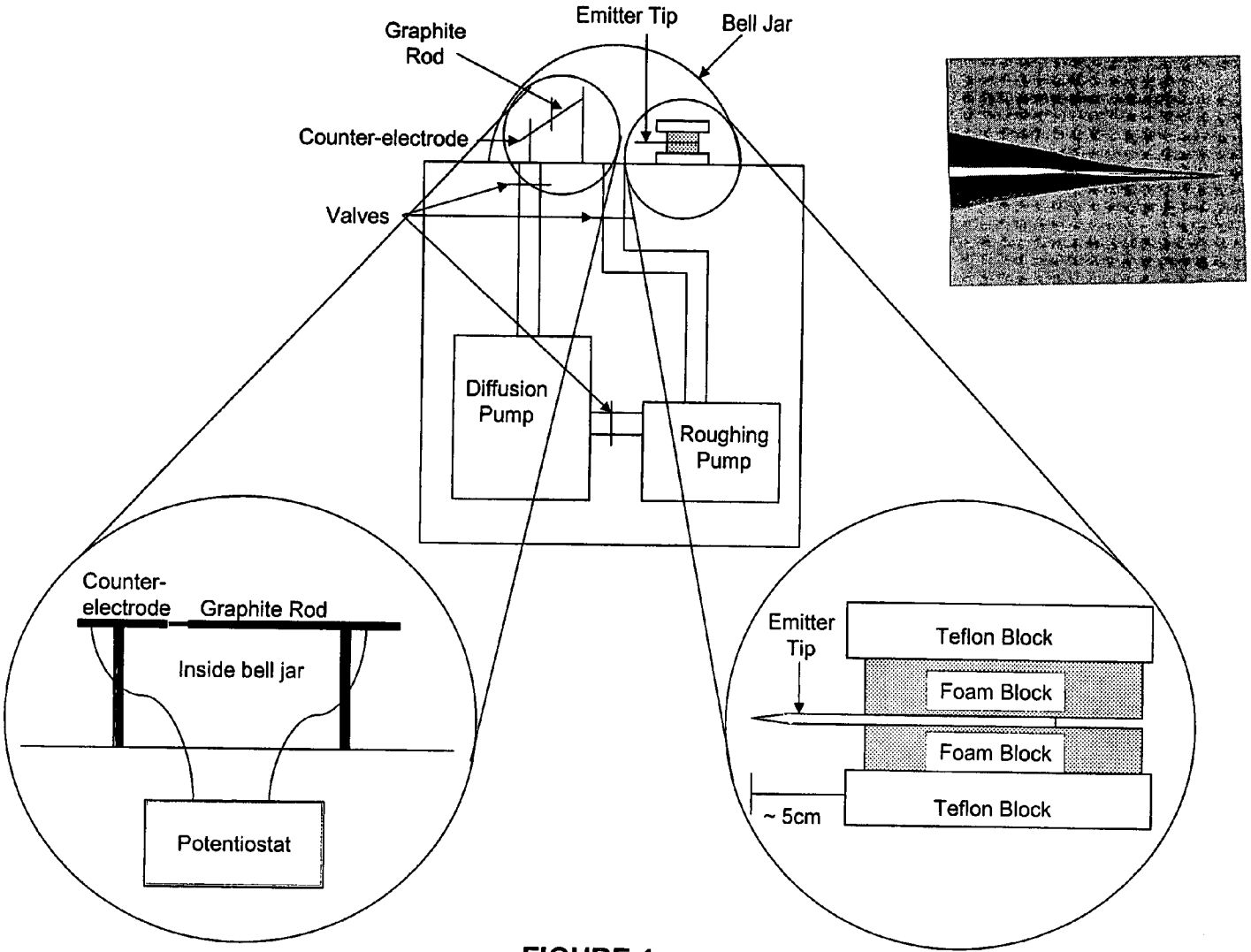
FIG. 1 shows a schematic of the evaporated graphite coating apparatus with expanded views of the emitter mount and the graphite rod. The emitter mount (see circle on the lower right corner) shows a nanoelectrospray emitter body sandwiched between two foam-mounted Teflon blocks. The bell jar, which is part of the deposition (evaporation) chamber, contains the electrically conductive material, i.e., the graphite rod, to which a potentiostat is connected (see circle on the lower left corner). The potentiostat supplies a current to the graphite rod until the graphite is evaporated and forms a coating on the nanoelectrospray emitter body. A typical evaporated-graphite-coated nanoelectrospray emitter is depicted in the micrograph in the top right, where the lightly shaded layer on the surface of the emitter illustrates the thin layer of graphite coating on the emitter.

The present invention relates to a method for coating nanoelectrospray emitters which involves providing a nanoelectrospray emitter body and evaporating an electrically conductive material under conditions effective to form a thin layer of the electrically conductive material onto the nanoelectrospray emitter body.

The nanoelectrospray emitter body can be formed of any material suitable for use in nanoelectrospray emitters, typically a glass or glass ceramic material. Suitable materials include, without limitation, borosilicate glass and glass ceramics, aluminosilicate glass and glass ceramics, and fused silica glass.

Emitter bodies can be pulled from glass or glass ceramic capillary tubes, forming a tapered (e.g., conical) portion of the body which has the outlet orifice at the tip thereof (see Wilm and Mann, "Electrospray and Taylor-Cone Theory, Dole's Beam of Macromolecules at Last?" *Int. J. Mass Spectrom. Ion Processes,* 136(1):167–180 (1994), which is hereby incorporated by reference in its entirety) or, alternatively, can be purchased (in a pre-pulled shape) from various commercial suppliers, including New Objective (Cambridge, Mass.).

The evaporating step can involve introducing the nanoelectrospray emitter body into a deposition chamber containing the electrically conductive material and applying a current to the electrically conductive material in the deposition chamber under conditions effective to coat the nanoelectrospray emitter body with the electrically conductive material. The current can be at a level of about 1 A to about 200 A.

Preferably, the current is applied under vacuum, typically of below 100 mTorr. This can be easily achieved by using commercially-available vacuum deposition chambers, such as those sold by Denton Vacuum (Moorestown, N.J.).

Suitable electrically conductive materials that can be used in the present invention include, but are not limited to, graphite, carbon nanotubes, fullerenes, and N- or P-doped semiconducting materials. The electrically conductive material is preferably graphite, where a graphite rod can be used to generate a graphite evaporative coating on the nanoelectrospray emitter bodies. The graphite rods used for evaporation are advantageous in that they are much cheaper than the raw materials required for most current coating technologies, especially the metal coating of emitters.

In another embodiment, the electrically conductive coating on the nanoelectrospray emitter body has a thickness of about 20 nm to about 30 nm.

The present invention describes a new conductive coating process for nanoelectrospray emitters. The evaporated electrically conductive coatings are stable in both negative and positive ionization modes. Moreover, this coating is not susceptible to electrical discharge under normal operating conditions. Even if electrical discharge takes place, the coating is durable and continues to generate useful spectra. The lower applied potential needed by these tips may allow for lower flow rates. This leads to a great reduction in required sample volume. Finally, the chief advantage of this coating is the speed and ease of the coating procedure. Emitters can be coated in less than 1 minute per piece with minimal operator handling. Because this is a vapor deposition technique, there is little chance of clogging the emitter orifice, and more importantly, there is no need for gas pressure while the emitter is being dipped into a solution. These advantages becomes important as packed silica capillaries for online capillary LC and CEC-MS are investigated. Using this approach, the silica capillary functions directly as the nanoelectrospray emitter, removing the need for a liquid junction or sheath-flow maintaining chromatographic integrity.

EXAMPLES

The following examples are provided to illustrate embodiments of the present invention but are by no means intended to limit its scope.

Example 1

Materials and Reagents

Borosilicate glass (10 cm long, 1.2 mm o.d., 0.9 mm i.d.) was purchased from Sutter Instrument Company (Novato, Calif.) and used without further modification. Cytochrome c and gastrin fragment were purchased from Sigma (St. Louis, Mo.). HPLC-grade methanol was obtained from Aldrich (Milwaukee, Wis.) and used as purchased. Aqueous samples were prepared using doubly distilled deionized water. Graphite rods (⅛ in.) were from Ted Pella, Inc. (Redding, Calif.) and were sharpened to 1-mm points prior to evaporative coating using an electric pencil sharpener.

Example 2

Production of Emitters

Fabrication of the nanoelectrospray emitters used a protocol previously reported by White and Wood, "Reproducibility in Fabrication and Analytical Performance of Polyaniline-Coated Nanoelectrospray Emitters," *Anal. Chem.,* 75:3660–3665 (2003), which is hereby incorporated by reference in its entirety. To summarize, a Sutter Instruments P-2000 $CO_2$ laser-based micropipette puller was used to pull borosilicate nanoelectrospray emitters with open emitter ends with an orifice i.d. of 4 $\mu$m. A 10-cm length of micropipet tubing was placed within the horizontal pulling arms of the laser puller. Heat was supplied by the laser until the glass reached a predetermined softness. At that point, the pulling arms exerted a force which pulled the heated segment apart, yielding two tapered emitters. Parameters were optimized to produce emitters with short tapers, relatively thick-walled orifices, and open emitter ends with orifices of 4 $\mu$m and a total emitter length of 5.5 cm. Each emitter took approximately 40 seconds to fabricate, starting from loading of the glass into the laser puller to removing of the pulled emitters from the evaporation chamber.

Example 3

Coating of Emitters

A general schematic of the coating apparatus is shown in FIG. 1. Each batch of emitters (ranging from 20 to 30 emitters each) was secured by double-sided tape to a Teflon plate (8 cm×20 cm) onto which a layer of foam had been mounted. A second Teflon plate with foam was placed on top of the emitters to form a sandwich. The two plates were secured to one another using transparent tape. Each emitter protruded approximately 5 cm beyond the Teflon, yielding a graphite coating of about 5 cm. The Teflon plates aided in preventing accidental breakage of the tips and eased the coating procedure, while the foam prevented crushing of the glass during handling. The evaporative coating was generated using a Denton Vacuum (Moorestown, N.J.) model DV502 graphite evaporation chamber. A 4-mm length of sharpened graphite was used for evaporation. The chamber reached a vacuum of below 100 mTorr before current was supplied to the graphite rod. A 10-V, 50-A current was passed through the graphite for approximately 5 seconds until the sharpened length was completely evaporated. This evaporative process created a graphite coating layer calculated to be 20–30 nm in thickness (as determined by the applied voltage, current, and length of time of evaporation). The chamber was then returned to atmospheric pressure. After one side of the emitter was coated, the plates could simply be flipped over to allow for quick and easy coating of the other side, helping to ensure total coverage of the emitter tip. After each side had been coated, the emitters were removed and stored until used. However, no curing time was needed, as is required with polymeric coatings, and the tips can be used immediately.

Example 4

Mass Spectrometry

Mass spectrometry experiments used a commercially available PE Sciex API-3000 triple-quadrupole mass spectrometer. A home-built nanoelectrospray source was designed and manufactured specifically for use with nanoelectrospray on the API-3000 instrument and has been described in Smith et al., "Design and Development of an Interchangeable Nano-Microelectrospray Source for a Quadrupole Mass Spectrometer," *Rev. Sci. Instrum.*, 74:4474–4477 (2003), which is hereby incorporated by reference in its entirety. A standard solution of 30 $\mu$M cytochrome c dissolved in 50/50 MeOH/$H_2O$ was used for all positive-ion-mode experiments, and 30 $\mu$M gastrin fragment dissolved in 50/50 MeOH/$H_2O$ was used in the negative ion mode. Individual emitters were placed 1–2 mm from the inlet orifice to the mass spectrometer, a voltage of 4.5 kV was supplied to the emitter tip to conduct nanoelectrospray (except where noted), and the endplate counter-electrode potential was 10 V. Borosilicate emitters used nanoelectrospray with a flow rate determined to be about 0.25 $\mu$L/h. Mass spectra were acquired using a Q1 scan from m/z 500 to 2500 for cytochrome c and from m/z 300 to 1500 for gastrin fragment with a step size of 0.1 m/z at 2 s/scan.

Example 5

Testing of the Graphite-Coated Nanoelectrospray Emitter

In order to show the usefulness of the evaporated graphite coated emitters, various nanoelectrospray experiments were conducted. A series of experiments were done in both positive and negative ion modes. The first set of experiments determined the functionality of the emitters in each ionization mode. Once functionality was determined, experiments were performed to show long-term durability over a period of hours. Finally, the mechanical stability of the evaporated coating was tested through an electrical discharge event.

Figure 2:
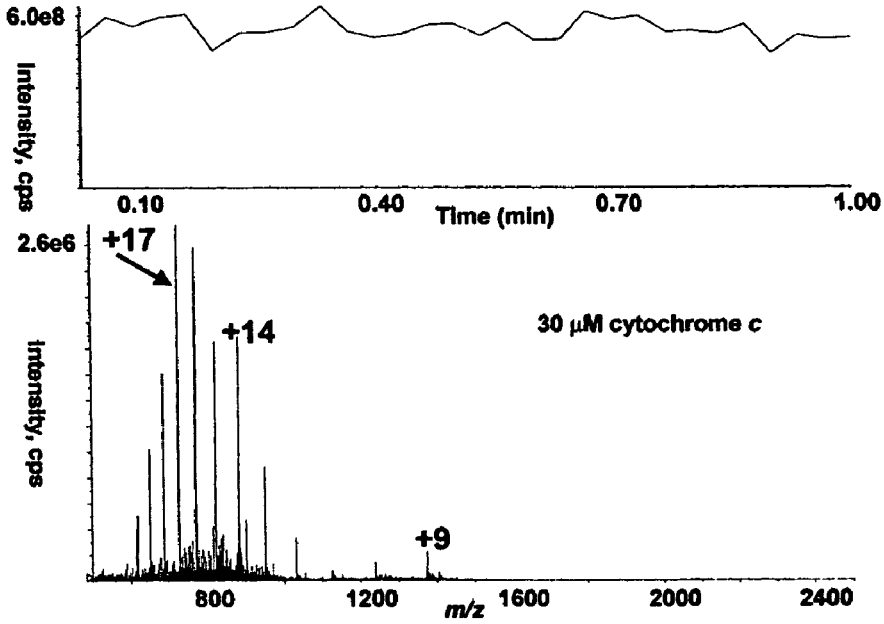
FIG. 2 shows a total ion chromatogram (TIC) (top) and nanoelectrospray mass spectrum (bottom) for 30 $\mu$M cytochrome c in positive ion mode using a vacuum-deposited-graphite-coated nanoelectrospray emitter. A charge state distribution of +9 (m/z 1374) to +20 (m/z 619) is observed.
Figure 3:
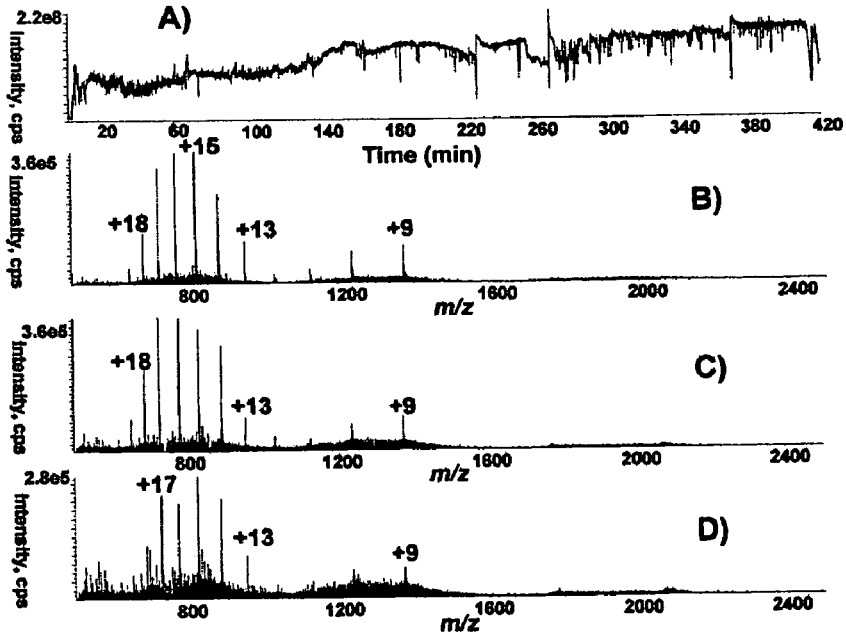
FIGS. 3A–D show a TIC (FIG. 3A) and nanoelectrospray mass spectra (FIGS. 3B–D) for a long-term experiment using 30 $\mu$M cytochrome c in positive ion mode with a vacuum-deposited-graphite-coated nanoelectrospray emitter. Mass spectra are 1-minute sums taken 2 h (FIG. 3B), 4 h (FIG. 3C), and 6 h (FIG. 3D) after initiation of nanoelectrospray.

First, to test for emitter usability, 5 $\mu$L of a standard cytochrome c solution was loaded into an emitter using a 10-$\mu$L Hamilton syringe. No arcing was evident, and mass spectra were recorded. FIG. 2 shows a representative spectrum and total ion chromatogram (TIC) acquired using an evaporated-graphite-coated nanoelectrospray emitter for cytochrome c. As can be seen in the TIC, the nanoelectrospray generated was relatively stable over 1 minute, yielding a spectrum with a signal-to-noise ratio of 11:1 for the 728.5 (+17) peak. The mass spectrum generated a charge state distribution from +9 (m/z 1374) to +21 (m/z 589), with a heme peak at m/z 616.5.

Figure 4:
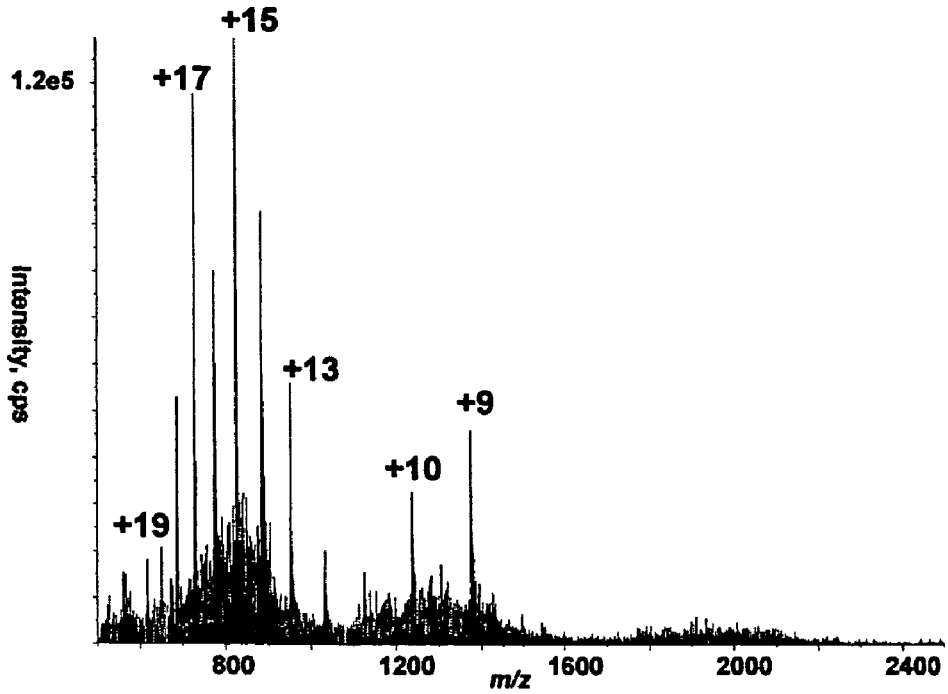
FIG. 4 illustrates a one-minute sum of scans taken after a 7-hour run from the TIC shown in FIG. 3A. The applied voltage was raised from 4.5 to 6 kV.
Figure 5:
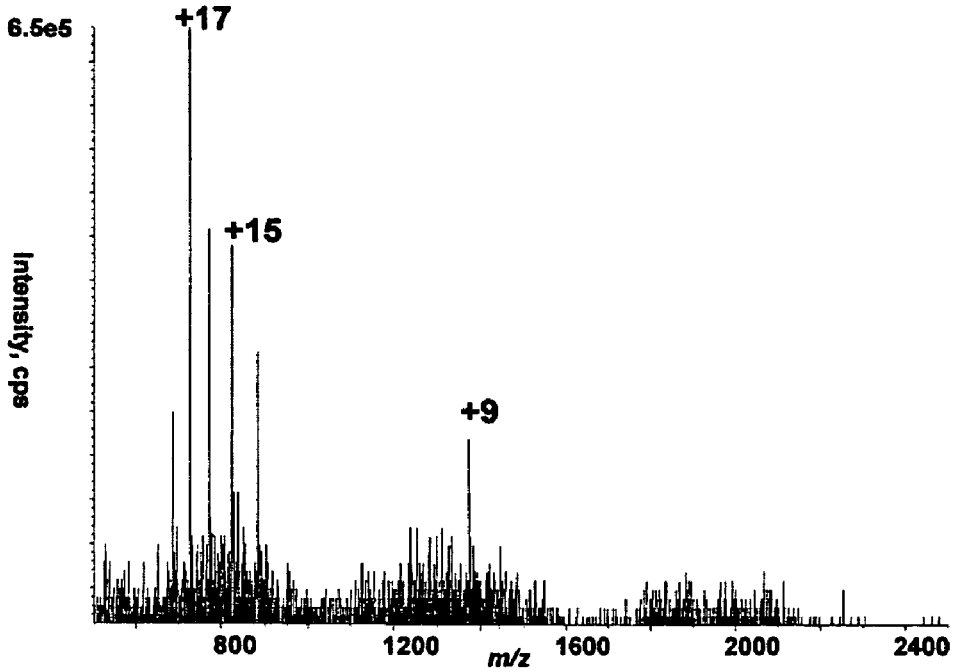
FIG. 5 shows a single scan from FIG. 3. Assuming a flow rate of 3 nL/min, only 3 fmol of sample was consumed to generate the spectrum. A signal-to-noise ratio of 8:1 is seen for m/z 728 (+17).
Figure 6:
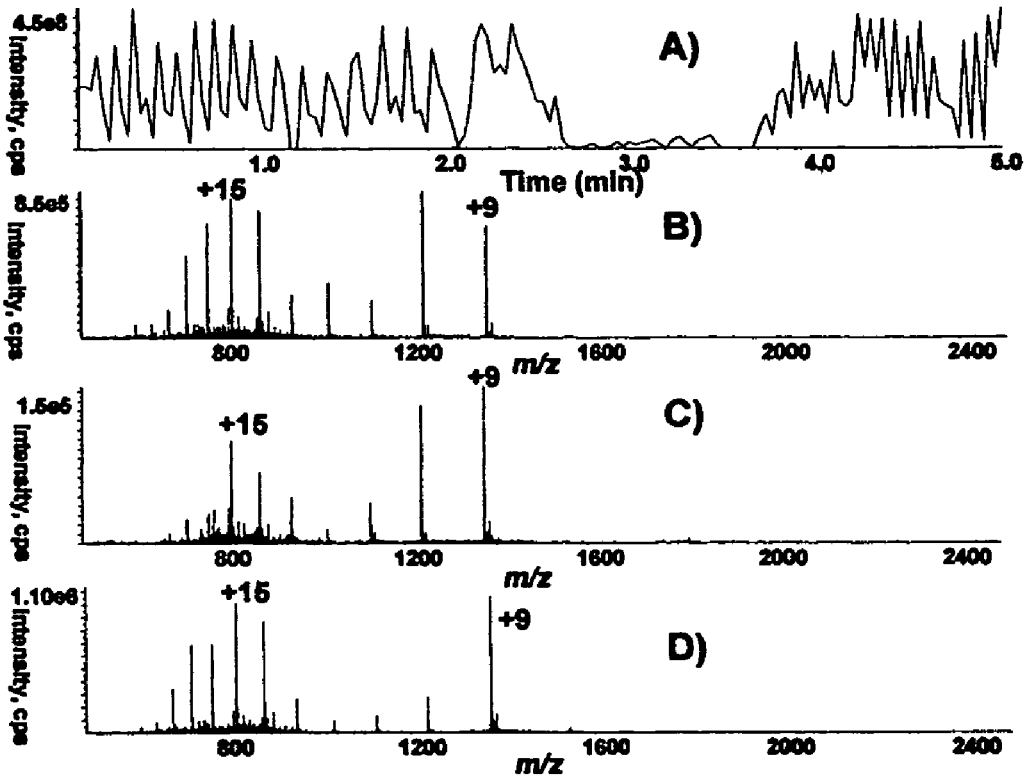
FIGS. 6A–D show a TIC (FIG. 6A) and nanoelectrospray mass spectra (FIGS. 6B–D) for an electrical discharge experiment in positive ion mode using a vacuum-deposited-graphite-coated nanoelectrospray emitter. The mass spectra in FIGS. 6B and 6D are at optimized conditions, with the mass spectrum in FIG. 6D being summed after an emitter was placed in the inlet orifice for 1.5 minutes. The mass spectrum in FIG. 6C was summed while the emitter was within the inlet orifice. Electrical discharge was not visually apparent, even when within the inlet orifice.

To show long-term usability, another emitter was loaded with 1 $\mu$L of cytochrome c solution and run continuously for 7 hours. FIGS. 3A–D show the TICs and mass spectra taken every 2 hours over the course of the experiment. Each spectrum is a 1-minute sum of 30 scans taken at 2, 4, and 6 h. As can be seen, the TIC was somewhat variable, but, over 7 hours, the TIC was relatively stable (total ion intensity±20% average over 15-min intervals). Each of the mass spectra showed the same charge state distributions of +9 (m/z 1374) to +19 (m/z 652). However, there was a slight decrease in signal-to-noise ratio at the 6-h mark. By 7 h, the signal-to-noise ratio approached 3:1 for the most intense peak, although the TIC continued to gradually increase. However, after 7 h, increasing the spray voltage from 4.5 to 6 kV caused the spectrum generated to have roughly the same profile as the 6-h spectrum (see FIG. 4). It is not entirely clear why the signal level was restored upon increasing the voltage. One might speculate that redox products (e.g. formation of $H^+$ from oxidation of water) accumulated over time. However, there was no evidence from the mass spectra that the pH (i.e., $H^+$ concentration) changed during the course of the experiment, as the charge state distributions were little changed over this period of time. It should be noted, even after 7 h, the 1 $\mu$L of loaded sample was not completely consumed. An appreciable amount of sample remained in the taper of the tip. A possible explanation is that, early in the experiment (before 6 h), a large enough amount of solution was in the nanoelectrospray tip to provide enough pressure to induce capillary action at the lower voltage (4.5 kV). As the sample was consumed (the volume in the emitter decreases), there was no longer sufficient pressure to push the solution through the tip. To reestablish signal, it was necessary to increase the applied voltage to exert a greater external force on the sample solution. Taking this into consideration, an upper limit to the flow rate was 3 nL/min. However, the actual flow rate must be somewhat lower, as an appreciable volume remained in the emitter tip even after 7 h. FIG. 5 shows a single 2 s scan. Using a 30 $\mu$M sample, this correlated to only 3 fmol of sample consumed with a signal-to-noise ratio of 8:1 for m/z 728 (+9).

To date, emitter stability has been a major issue, particularly the hardiness of the applied conductive coating. To determine the robustness of the evaporated graphite coating, experiments were conducted in which electrical discharge was intentionally induced and maintained while signal was being acquired. FIGS. 6A–D show a representative result of these experiments. Each spectrum is a 30-s sum of 15 scans taken during the 1.5–2.0-, 3.0–3.5-, and 4.5–5.0-min time periods, as described below. Signal response was optimized via lateral emitter position to maximize ion current, and mass spectra were acquired for 2.5 min. The emitter was then directed into the inlet orifice of the mass spectrometer. Upon visual inspection, there did not appear to be any arcing between the emitter and the endplate electrode. The emitter was left within the inlet orifice for 1.5 min when it was then returned to its optimal position, and signal was acquired for an additional 1.5 min. As can be seen, signal was maintained, and a usable mass spectrum was acquired even when the emitter was within the endplate orifice. The overall intensity was lower while the emitter was in the endplate, but the signal returned to its previous level once the emitter was returned to its optimized position. The apparent lack of arcing may be due to the decreased applied potential compared to that encountered in other types of nanoelectrospray emitters, the electrochemical stability of the graphite, or even the relatively thin layer compared to most metallized and polymer-coated conductive films on nanoelectrospray emitters.

Figure 7:
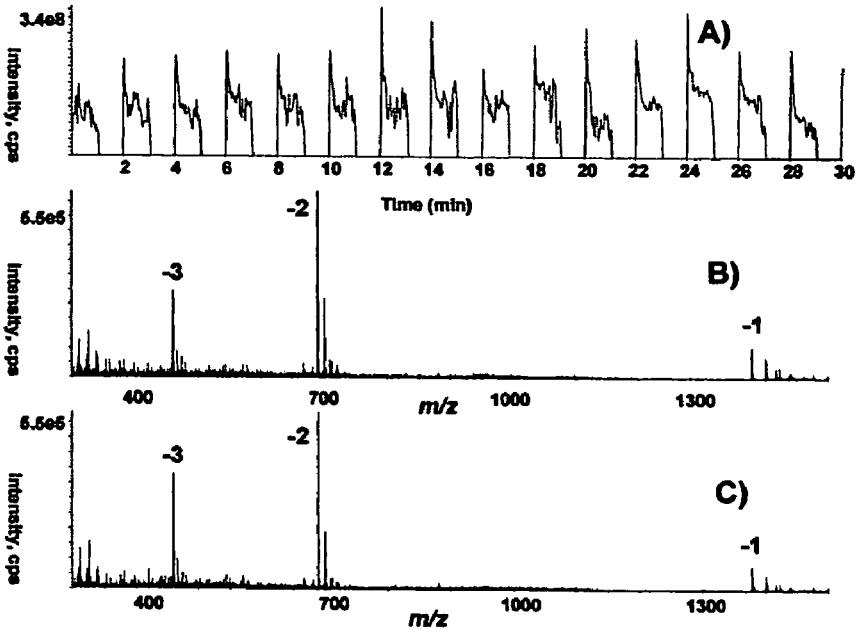
FIGS. 7A–C show a TIC (FIG. 7A) and nanoelectrospray mass spectra (FIGS. 7B–C) for a pulsed-voltage experiment using a vacuum-deposited-graphite-coated nanoelectrospray emitter. Voltage was switched between −5 kV and 0 V every minute for 30 minutes. Mass spectra are from the 2–3-min and 28–29-min time periods.
Figure 8:
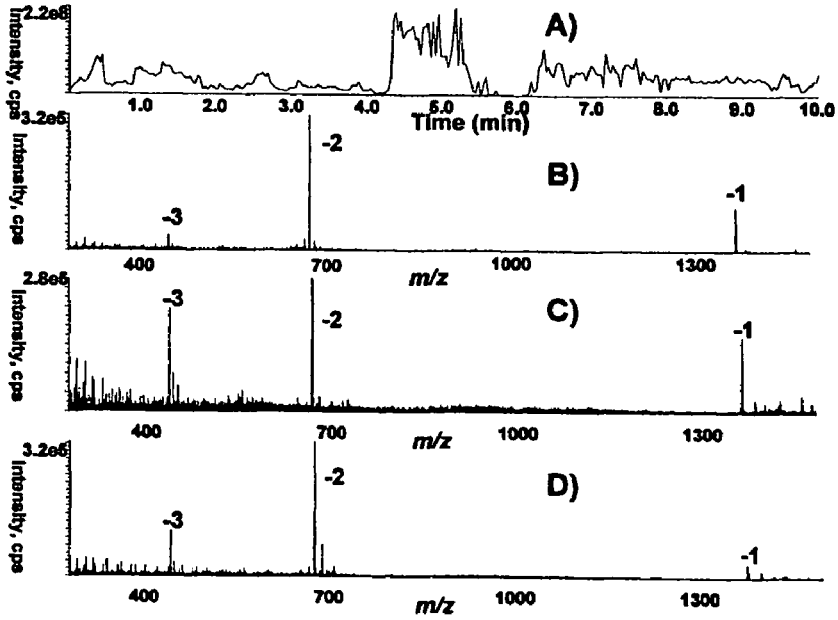
FIGS. 8A–D show a TIC (FIG. 8A) and nanoelectrospray mass spectra (FIGS. 8B–D) for an electrical discharge experiment in negative ion mode using a vacuum-deposited-graphite-coated nanoelectrospray emitter. The mass spectra in FIGS. 8B and 8D are at optimized conditions, with the mass spectrum in FIG. 8D being summed after an emitter was discharged for 3 minutes. The mass spectrum in FIG. 8C was summed while the emitter was discharging. While discharging, the emitter glowed a brilliant blue/violet color.

In addition, emitter performance was investigated using negative ion mode. It has been noted that electrical discharge is more likely to occur when operating in the negative ion mode (Bruins, "Mechanistic Aspects of Electrospray Ionization." *J Chromatogr. A,* 794:345–357 (1998), which is hereby incorporated by reference in its entirety). To show emitter durability when high voltage is applied, a pulsed-voltage experiment was conducted. This experiment entailed switching the applied voltage from −5 kV to 0 V back to −5 kV every minute over 30 minutes. As can be seen in FIGS. 7A–C, the signal intensity dropped to zero as the applied voltage was switched to 0 V. However, the signal response returned once −5 kV was reapplied. The emitter response was nearly identical for each "spike". The spectra are 1-min sums between the 2–3-min- and 28–29-min time periods. Each spectrum shows the −1 (m/z 1379) to −3 (m/z 459) charge states, along with salt adducts.

Finally, because electrical discharge is a major issue in negative ion mode, intentional discharge was induced to illustrate the robustness of the coating. FIGS. 8A–D show the TIC and mass spectra for a discharge experiment. Each spectrum is a 1-min sum of 30 scans taken during the 1.5–2.5-, 4.5–5.5-, and 7.5–8.5-min time periods, as described below. The emitter response was optimized, and mass spectra were acquired for 4 min. The emitter was then moved toward the inlet orifice until arcing was discernible. The emitter was left in the arcing field for 3 min until it was repositioned at its optimal location for another 3 min. During arcing, visual inspection showed the emitter tip to be a brilliant blue color due to constant electrical discharge. However, as can be seen from the mass spectra, the emitter did not fail, and indeed, the response was nearly identical to that observed at the optimized location. Thus, not only can these emitters survive electrical discharge (even continuously for 3 min), they can produce usable mass spectra while arcing is taking place. Thus far, evaporated graphite films are the only coatings to exhibit such performance during electrical discharge during nanoelectrospray.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A method for coating nanoelectrospray emitters comprising:

providing a nanoelectrospray emitter body and evaporating an electrically conductive material under conditions effective to form a thin layer of the electrically conductive material onto the nanoelectrospray emitter body.

2. The method according to claim 1, wherein said evaporating comprises:

introducing the nanoelectrospray emitter body into a deposition chamber containing the electrically conductive material and applying a current to the electrically conductive material in said deposition chamber under conditions effective to coat the nanoelectrospray emitter body with the electrically conductive material.

3. The method according to claim 2, wherein the current is at a level of about 1 A to about 200 A.

4. The method according to claim 2, wherein said applying is carried out under vacuum.

5. The method according to claim 4, wherein said vacuum is below 100 mTorr.

6. The method according to claim 1, wherein the electrically conductive material is selected from the group consisting of graphite, carbon nanotubes, fullerenes, and N- or P-doped semiconducting materials.

7. The method according to claim 6, wherein the electrically conductive material is graphite.

8. The method according to claim 1, wherein the nanoelectrospray emitter body comprises a glass or glass ceramic material.

9. The method according to claim 8, wherein the glass or glass ceramic material is a borosilicate, aluminosilicate, or fused silica material.

10. The method according to claim 1, wherein the thin layer of electrically conductive material has a thickness of about 20 nm to about 30 nm.

* * * * *